US005746361A

United States Patent [19]

Johnson

[11] Patent Number: 5,746,361

[45] Date of Patent: May 5, 1998

[54] CARRIER FOR TRANSPORTING ELONGATE RECREATIONAL EQUIPMENT

[76] Inventor: Randall LeRoy Johnson, 1123 Princeton Ave., Lansing, Mich. 48915

[21] Appl. No.: 609,861

[22] Filed: Mar. 1, 1996

[51] Int. Cl.[6] ..... A45F 3/14

[52] U.S. Cl. ..... 224/258; 224/250; 224/245; 224/578; 224/607; 224/622; 224/917; 224/584

[58] Field of Search ..... 224/917, 250, 224/257, 258, 578, 242, 245, 607, 622, 625, 584; 294/147; 280/814

[56] References Cited

U.S. PATENT DOCUMENTS

| | | | |
|---|---|---|---|
| D. 258,703 | 3/1981 | Ogle et al. . | |
| D. 332,071 | 12/1992 | Borden . | |
| 4,308,982 | 1/1982 | Hall | 224/917 |
| 4,483,380 | 11/1984 | Beran . | |
| 4,673,118 | 6/1987 | Kronz | 224/917 |
| 4,790,460 | 12/1988 | Harper, Jr. . | |
| 4,792,073 | 12/1988 | Jacober | 224/917 |
| 4,819,845 | 4/1989 | Byrd . | |
| 4,878,585 | 11/1989 | Orestano . | |
| 5,083,692 | 1/1992 | Treese . | |
| 5,092,506 | 3/1992 | Bolduc . | |
| 5,096,103 | 3/1992 | Baugh . | |
| 5,163,550 | 11/1992 | Hawk . | |
| 5,344,056 | 9/1994 | Challoner et al. . | |
| 5,350,096 | 9/1994 | Sieber . | |
| 5,383,537 | 1/1995 | Carpenter . | |

*Primary Examiner*—Linda J. Sholl
*Attorney, Agent, or Firm*—Ian C. McLeod; Mary M. Moyne

[57] ABSTRACT

A carrier (10) for transporting a snowboard (100) is described. The carrier includes a panel (12) on which are mounted top and bottom securing straps (24 and 26) which are securing through top and bottom securing buckles (30 and 32), on the opposite side of the panel. The snowboard is mounted adjacent the inner surface (12F) of the panel such that the sides (12C and 12D) of the panel are adjacent the sides (100C) of the board. A first carrying strap (34) is mounted at the top (12A) of the panel on the right side (12C) and a second carrying strap is mounted at the bottom (12B) of the panel on the left side (12D). The second ends (24B and 26B) of the first and second carrying straps are connected together to form a complete strap. To use, the user (102) inserts an arm (104) and head (106) through the complete strap such that the complete strap extends across the torso (108) of the user and the panel is adjacent the back (110) of the user. When mounted correctly, the snowboard is positioned vertically along the back of the user. Non-slip pads (18) on the inner surface of the panel contact the sides (100C) of the snowboard and prevent the snowboard from moving during transportation. The complete strap is adjustable to allow for varying the position of the snowboard vertically along the back of the user.

27 Claims, 9 Drawing Sheets

CARRIER FOR TRANSPORTING ELONGATE RECREATIONAL EQUIPMENT

BACKGROUND OF THE INVENTION (1) Field of the Invention

The present invention relates to a carrier for transporting a snowboard or other elongate object on a back of a user. In particular, the present invention relates to a snowboard carrier for transporting a snowboard vertically on the back of a user using a carrier with a carrying strap which extends over one shoulder and under the opposite arm of the user. The carrying strap is adjustable to allow the user to correctly position the snowboard along the back of the user to allow for easy carrying of the snowboard. The carrier is also provided with a locking cable which allows the user to lock the carrier and snowboard to a fixed object to prevent theft of the snowboard when the user is not present.

(2) Description of the Related Art

The related art has shown various devices for carrying recreational equipment such as skis, snowboards, skateboards and the like. Illustrative are U.S. Pat. Nos. 4,790,460 to Harper, Jr.; 4,819,845 to Byrd; 5,344,056 to Challoner et al; 5,350,096 to Sieber and 5,383,537 to Carpenter.

Harper, Jr. shows a carrier for a skateboard which supports the skateboard vertically along the back of the user. The carrier includes a body having front and back panels within which is mounted a resiliently deformable support pad. A pair of shoulder straps is affixed to the front panel. A plurality of flexible, inelastic securing strap attachment members with a D-ring affixed to the free end are affixed to the end edges of the front and back panels. A plurality of flexible, inelastic securing straps are attached respectively to the uppermost and lowermost securing strap attachment members. In operation, the skateboard is positioned on the body using the cinch straps passed through the attachment members. The shoulder straps are then adjusted for fit and comfort. The carrier is hoisted onto the back with the arms of the user passed through the straps.

Byrd describes a ski carrier apparatus which mounts over one shoulder of a user. The apparatus includes a load-carrying element which has a hook section which mounts over the shoulder of the user and an equipment attachment section for attachment of the skis. The load-carrying element is a strong and durable frame-like structure capable of supporting the weight of the skis and is preferably formed from at least one structural member. A cushion is mounted on the inside of the load-carrying element and extends slightly beyond the ends of the element. A shoulder belt extends over the load-carrying element on the side opposite the cushion. The belt is attached at opposite lateral edges to the cushion. The shoulder belt and the cushion cooperate to engage the structural member along its entire length thereby containing both the shoulder belt and the cushion to follow the counters of the structural member. The apparatus further comprises an attachment assembly comprised of first and second strap assemblies which function to releasably secure the equipment (skis) to the carrier. The apparatus also includes a waist belt which is connected by cross straps to the ends of the load-carrying element which functions to releasably hold the load-carrying element in a stable position when the hook extension has been fitted over the shoulder of a user and the equipment attachment section extends diagonally across the back of the user.

Challoner et al shows a carrier case for carrying a recreational board such as a skateboard, snowboard, surfboard or the like. The case is comprised of first, second and third engagement means for holding the board in contact with the base of the case. The first engagement means engages the top of the board and can be in the form of a pouch or compartment or a strap. The second engagement means holds the bottom of the board and is described as a pouch or compartment. The third engagement means are preferably a plurality of straps which are connected to the base and secured across the midsection of the board. A shoulder strap is attached at one end to the top of the carrier case and at the other end to the bottom of the carrier case. The carrier case can be folded and stored in the pouch of the second engaging means when not in use. In the particular embodiment of the carrier case for a snowboard, a pair of shoulder straps are provided on the back of the base having respective first ends located in the midsection generally closer to the distal end of the base. The second ends are detachable from a connecting means located on the back of the base in various positions. When the board is encased in the carrier case, the middle of the board is preferably comfortably positioned and balanced on the user's back.

Sieber describes a ski carrying device for carrying the skis on the user's back. The ski carrying device comprises an upper cover and a lower cover each of which surrounds the corresponding portions of the ski bindings. The device has at least one carrying strap for carrying the device over the user's shoulder. Preferably, the device includes two (2) straps which are attached to and extend between the two covers and are mounted over both of the user's shoulders. Alternatively, the second strap is only connected to the lower cover and extends around the user's waist. During carrying, the skis are retained in a generally vertical position on the skier's body. The carrier can be converted into a hip pocket when not in use.

Carpenter describes a device for carrying elongated ski equipment such as skis and ski poles, as well as snowboards and the like. The device includes a single, fabric strap which is folded over upon itself so that the first end overlaps the second end and forms a closed loop. The user extends his arm through the closed loop to fit the device over his shoulder. First, second and third segments of the strap form an outer and inner pocket adjacent the bottom end of the closed loop. A tie strap is attached to the rear side of the closed loop adjacent the top end of the loop and is used to secure the skis to the loops. The tie strap is attached at a point above the binding and positions the center of gravity of the skis between the tie strap and the outer pocket. Consequently, the center of gravity of the skis is always at a level below the level of the user's shoulder. When not in use, the ski sling can be converted into a compact, substantially flat, pliable package that may be easily stored within a coat pocket.

Also of interest are U.S. Pat. Nos. Des. 258,703 to Olge et al; 4,483,380 to Beran; 5,083,692 to Treese; 5,092,506 to Bolduc and 5,163,550 to Hawk.

Only of minimal interest are U.S. Pat. Nos. Des. 332,071 to Borden; 4,878,585 to Orestano and 5,096,103 to Baugh.

The devices of the prior art however do not allow for easy, comfortable and stable carrying of the recreational boards. To carry the boards vertically, the prior art devices use a harness-like double strap or a rigid shoulder member. Those prior art devices using only a single strap do not securely hold the recreational board in a vertical and stable position. Therefore, carrying recreational boards using prior art devices was awkward and uncomfortable. There remains the need for a carrier which enables a user to comfortably transport a snowboard or the like vertically and securely without unbalance of the board using a carrier having a carrier strap where the carrier strap is preferably adjustable to allow the user to position the board vertically along the back of the user to locate the best carrying position.

OBJECTS

It is therefore an object of the present invention to provide a carrier for recreational boards such as snowboards or the like which allows the user to transport the recreational board vertically along the back of the user. Further, it is an object of the present invention to provide a carrier which has an adjustable carrying strap which allows the user to adjust the vertical position of the recreational board along the back of the user. Further still, it is an object of the present invention to provide a carrier which has a locking cable which allows the user to lock the recreational board and carrier to a fixed object to prevent theft of the snowboard when the user is not present. Further, it is an object of the present invention to provide a carrier which is convertible to a waist pack when the user is not carrying the recreational board. It is further an object of the present invention to provide a carrier which is lightweight and durable and which is easily mounted on the user and which allows for easy, hands free transporting of the recreational board. These and other objects will become increasingly apparent by reference to the following drawings and the description.

DETAILED DESCRIPTION OF THE PREFERRED EMBODIMENTS

Figure 1:
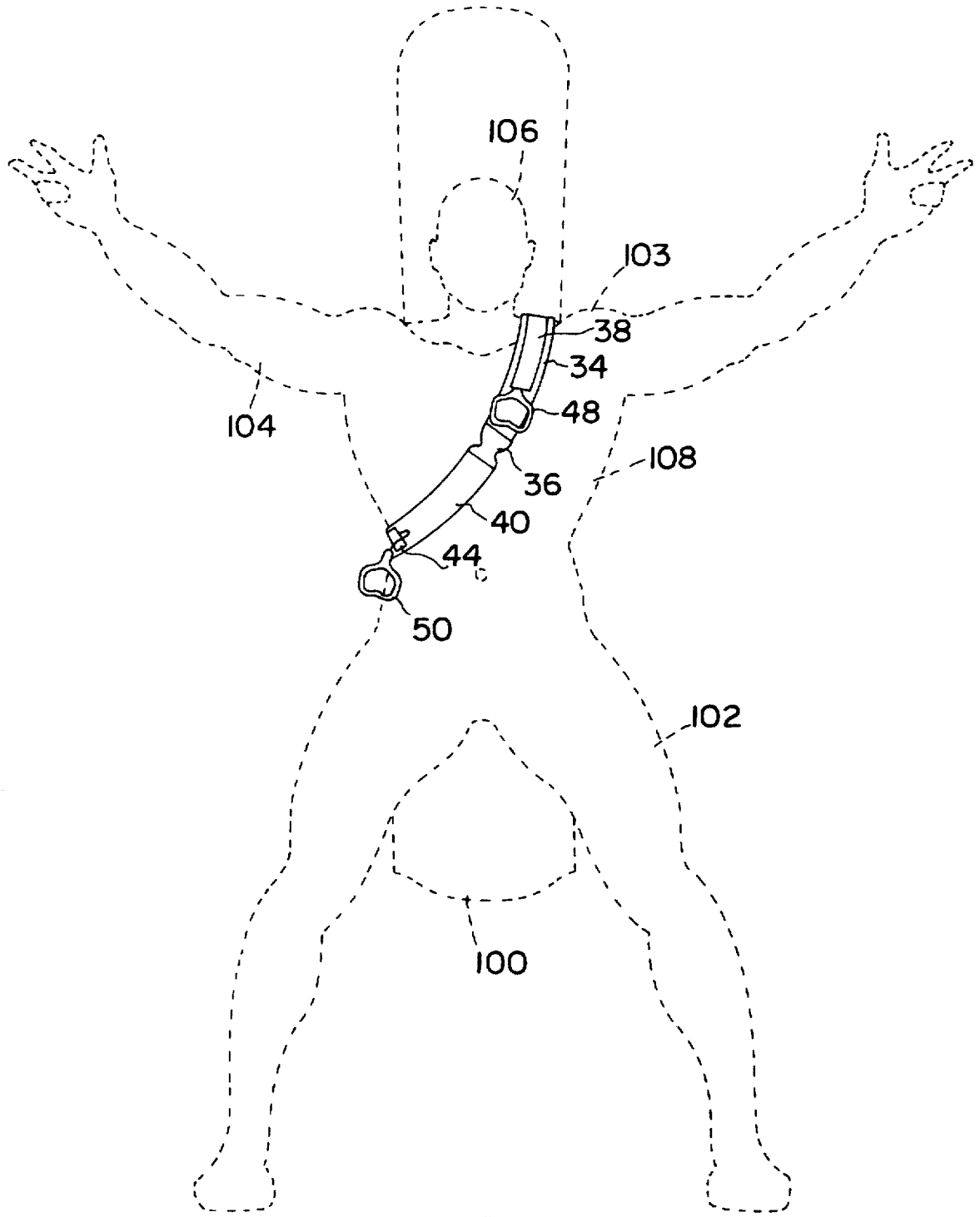
FIG. 1 is a front view of the user 102 with the carrier 10 over a left shoulder and around the torso 108 of the user 102.
Figure 2:
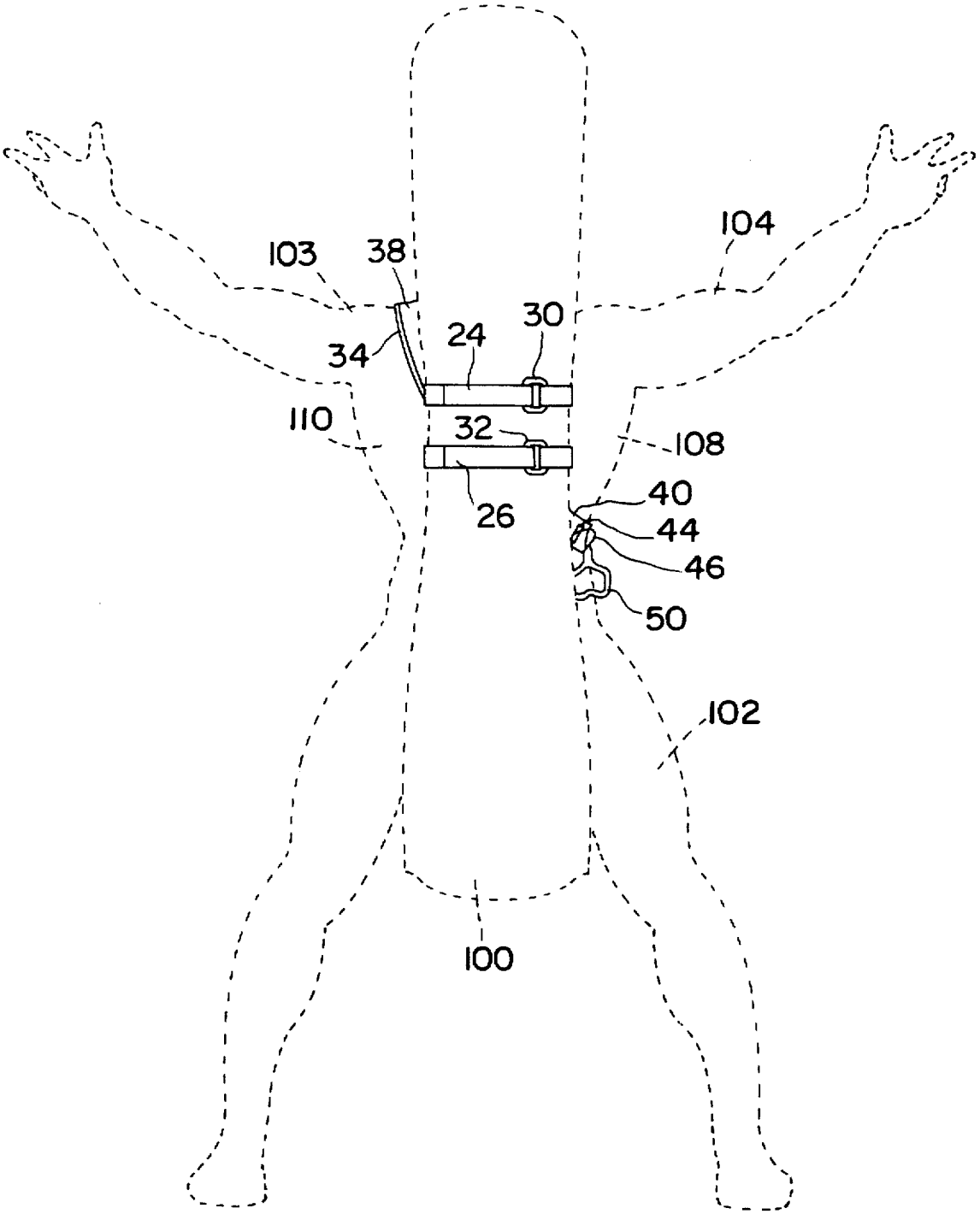
FIG. 2 is a back view of the user 102 showing the carrier 10 holding a snowboard 100 in a vertical position.
Figure 3:
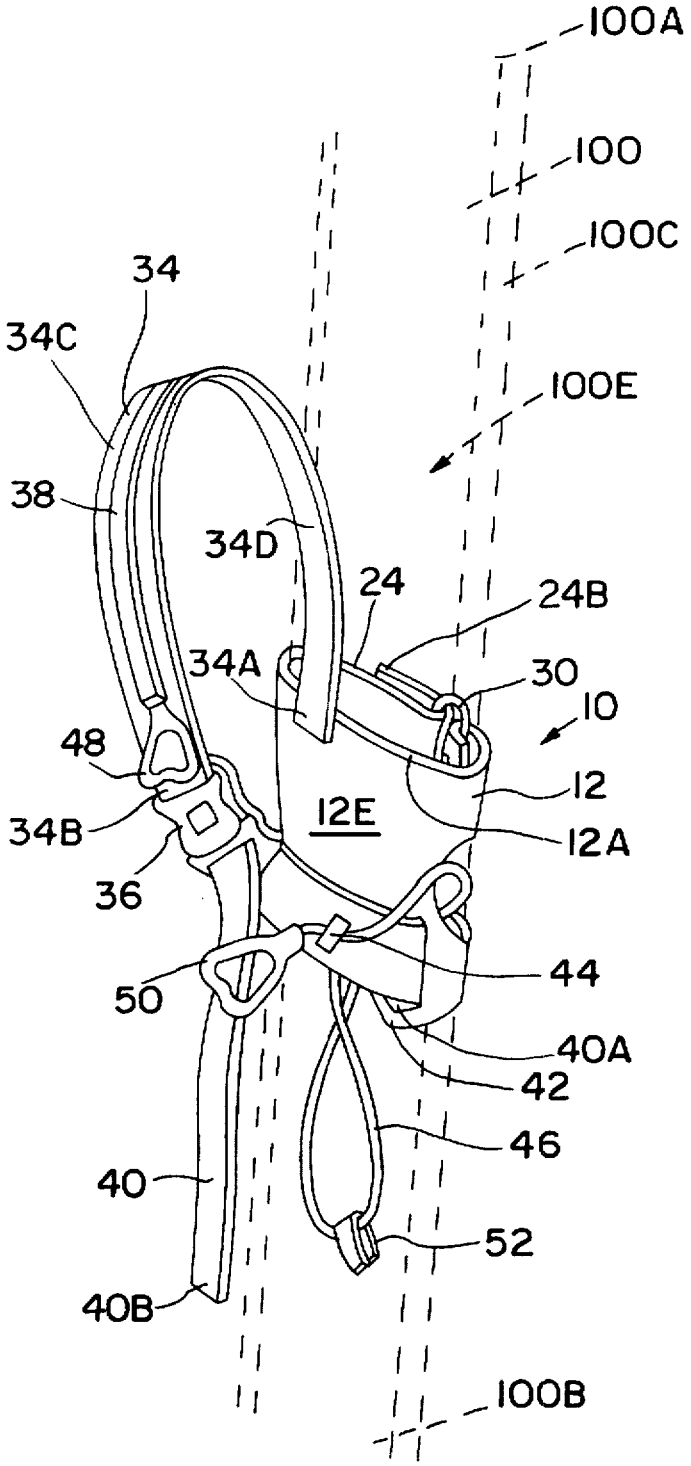
FIG. 3 is a perspective view of the carrier 10.

The present invention relates to an apparatus for carrying an elongate object on a back of a user, which comprises: a panel having a top and a bottom and opposed sides with an inner surface and an outer surface spaced therebetween; a securing strap having opposed ends and extending from one side of the panel; an attachment means provided on the other side of the panel opposite the securing strap for holding the securing strap in position across the inner surface of the panel; and a complete carrying strap having a first end and a second end with the first end and provided on the panel adjacent the top and one of the sides of the panel with the second end provided on the panel adjacent the bottom and the other side of the panel, wherein the second end of the complete carrying strap provided on the panel such that the complete carrying strap extends upward from the second end of the carrying strap at an angle toward the top of the panel such that an acute angle is formed between the first end and second end of the carrying strap, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user.

Further, the present invention relates to an apparatus for carrying an elongate object on a back of a user, which comprises: a panel having a top and a bottom and opposed sides with an inner surface and an outer surface spaced therebetween; a securing strap having opposed ends and extending on one side of the panel; an attachment means provided on the other side of the panel opposite the securing strap for holding the securing strap in position across the inner surface of the panel; a complete carrying strap having a first end and a second end with the first end provided on the panel adjacent the top and one of the sides of the panel with the second end provided on the panel adjacent the bottom and the other side of the panel, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user; and a locking cable having opposed ends and extending from the first end of the carrying strap to the second end of the carrying strap across the inner surface of the panel for locking the apparatus with the elongate object to a fixed object to prevent theft of the elongate object.

Still further, the present invention relates to an apparatus for carrying an elongate object on a back of a user, which comprises: a panel having a top and a bottom with opposed sides and an outer surface and an inner surface spaced between the sides; a securing means including a securing strap having opposed ends and extending from one side of the panel and a loop provided on the other side of the panel wherein the securing strap extends through the loop such that the strap extends across the elongate object to hold the elongate object in the apparatus when the elongate object is mounted adjacent the inner surface of the panel; a first carrying strap having opposed ends and provided at one end on the panel adjacent the top and one side of the panel such as to extend outward away from the panel; and a second carrying strap having opposed ends and provided at one end on the panel adjacent the bottom and the other side of the panel so as to extend upward at an angle toward the top of the panel such that an acute angle is formed between the first carrying strap and the second carrying strap, wherein the second ends of the first and second carrying straps are fastened together to form a complete carrying strap and wherein the complete carrying strap can be mounted over one shoulder and around a neck of the user such that the complete carrying strap extends diagonally across a torso of the user with the outer surface of the panel back of the back of the user and wherein the elongate object can be mounted adjacent the panel and held in a vertical position along the back of the user.

Further still, the present invention relates to a combination elongate object carrier and waist pack, which comprises: a panel having a top and a bottom and opposed sides with an inner surface and an outer surface spaced therebetween; a securing strap having opposed ends and extending from one side of the panel; an attachment means provided on the other side of the panel opposite the securing strap; and a complete carrying strap having a first end and a second end with the first end provided on the panel adjacent the top and one of the sides of the panel and the second end provided on the panel adjacent the bottom and the other side of the panel, wherein the second end of the complete carrying strap extends upward from the second end of the carrying strap at an angle toward the top of the panel such that an acute angle is formed between the first end and second end of the carrying strap, wherein in the elongate object carrier configuration the carrying strap can be mounted over one shoulder and around a neck of the user such that the complete carrying strap extends diagonally across a torso of the user with the outer surface of the panel adjacent the back of the user, wherein the object can be mounted adjacent the panel and held in a vertical position along the back of the user, and wherein in the waist pack configuration, the first and second carrying straps are extended around a waist of the user and fastened together at their second ends such that the outer surface of the panel is adjacent the waist of the user.

Further, the present invention relates to a method for carrying an elongate object adjacent the back of a user, the elongate object having a top and a bottom with sides therebetween, which comprises: providing a panel having a top and a bottom and opposed sides with an inner surface and an outer surface spaced therebetween; a securing strap having opposed ends and extending from one side of the panel; an attachment means provided on the other side of the panel opposite the securing strap for holding the securing strap in position across the inner surface of the panel; and a complete carrying strap having a first end and a second end with the first end provided on the panel adjacent the top and one of the sides of the panel and the second end provided on the panel adjacent the bottom and the other side of the panel, wherein the second end of the complete carrying strap extends upward from the second end of the carrying strap at an angle toward the top of the panel such that an acute angle is formed between the first end and second end of the carrying strap, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user; mounting the elongate object adjacent the inner surface of the panel such that the elongate object is spaced between the sides of the panel with the sides of the elongate object adjacent the sides of the panel; securing the securing strap across the elongate object such that the elongate object is completely encircled by the panel and the securing strap to prevent extraneous movement of the elongate object; and extending a head and a shoulder through the complete carrying strap such that the complete carrying strap extends diagonally across a torso of the user and the outer surface of the panel is adjacent the back of the user wherein the elongate object is held adjacent the back of the user in a vertical position such that the top of the elongate object is adjacent a head of the user.

Figure 4:
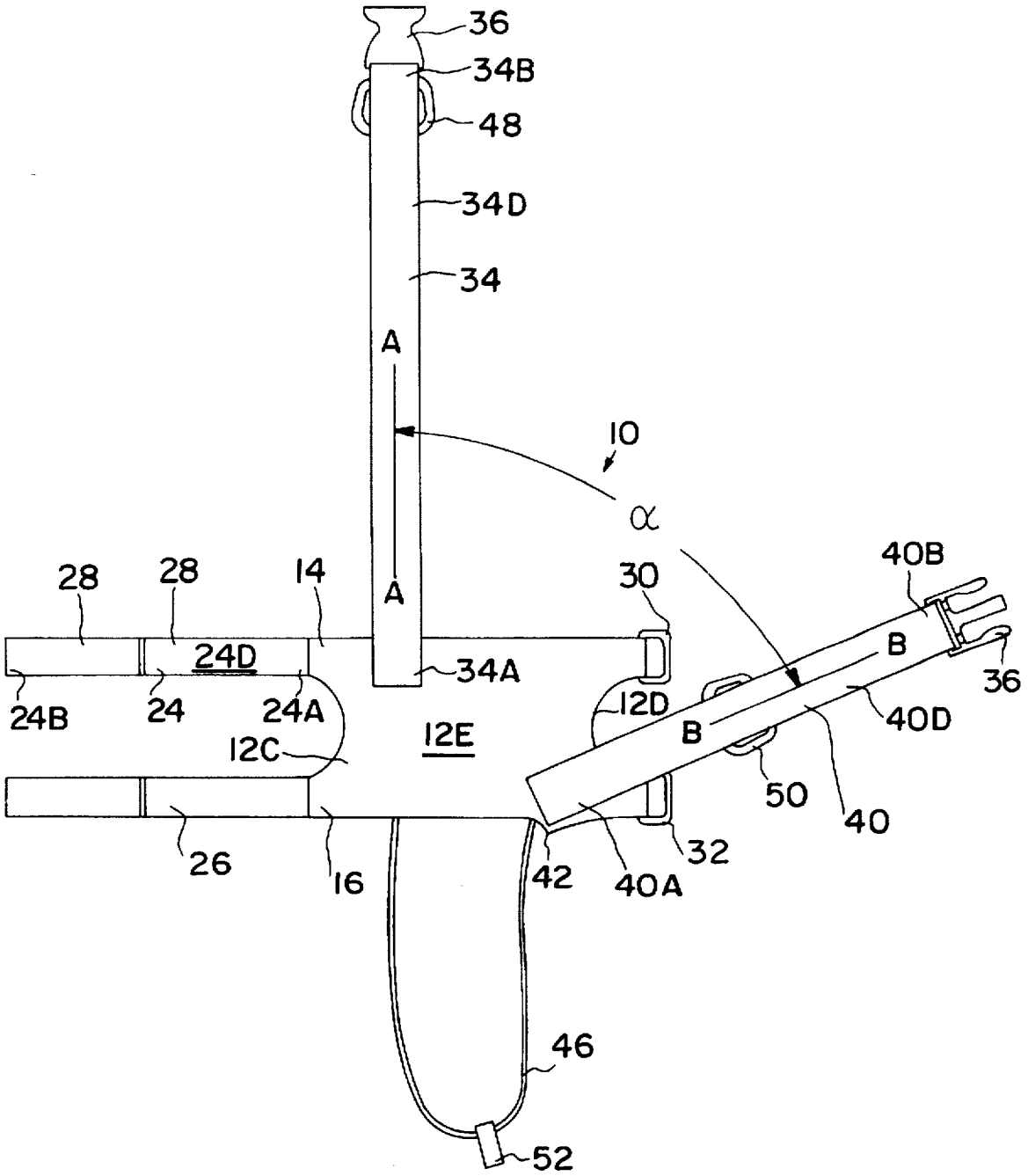
FIG. 4 is a back view of the carrier 10 showing the outer surface 12E of the panel 12 with the first ends 34A and 40A of the first and second carrying straps 34 and 40 and showing the top and bottom securing straps 24 and 26 and the top and bottom securing buckles 30 and 32.
Figure 5:
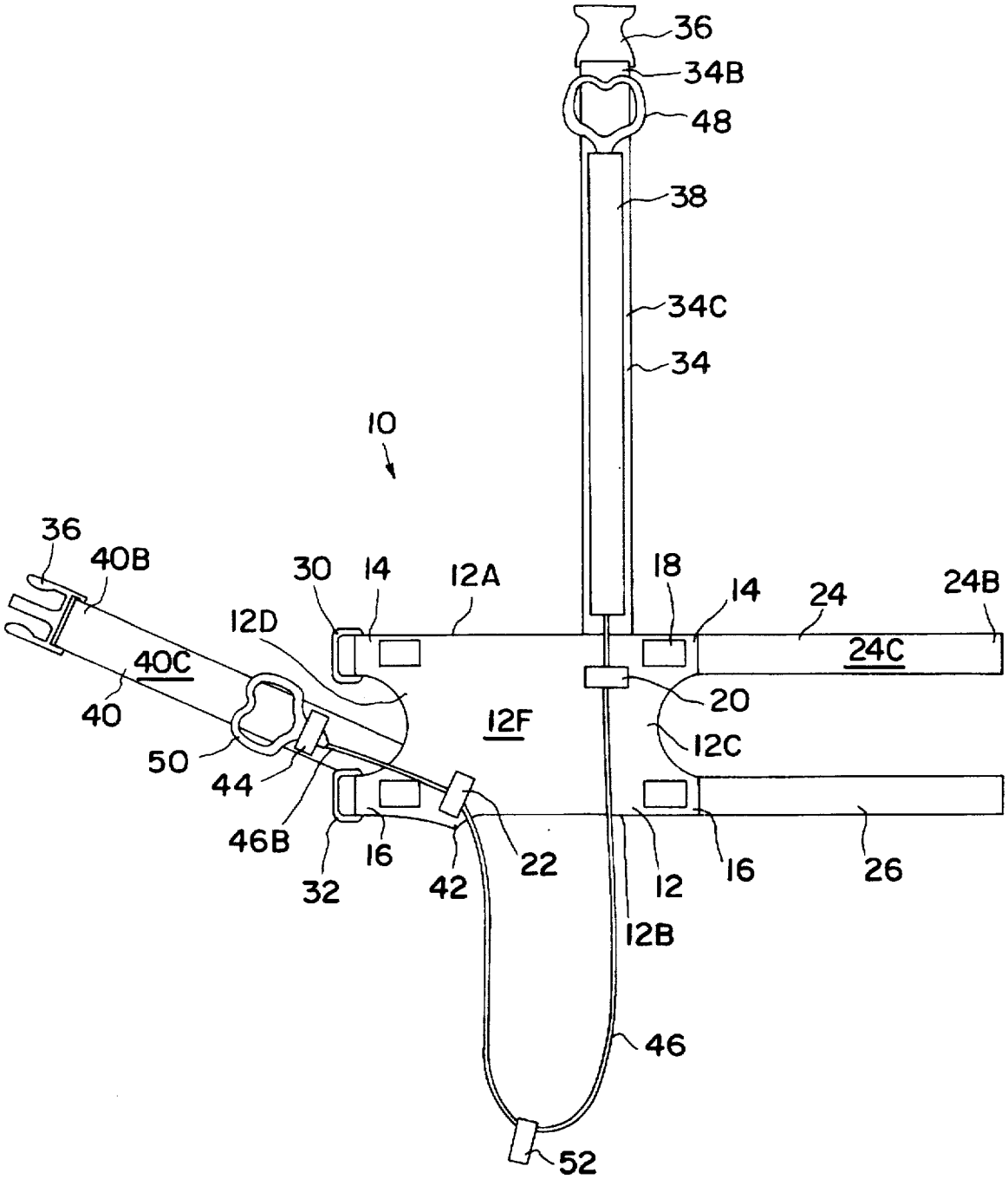
FIG. 5 is a front view of the carrier 10 showing the inner surface 12F of the panel 12 with the locking cable 46 extending from the first carrying strap 34 across the panel 12 to the second carrying strap 40.
Figure 6:
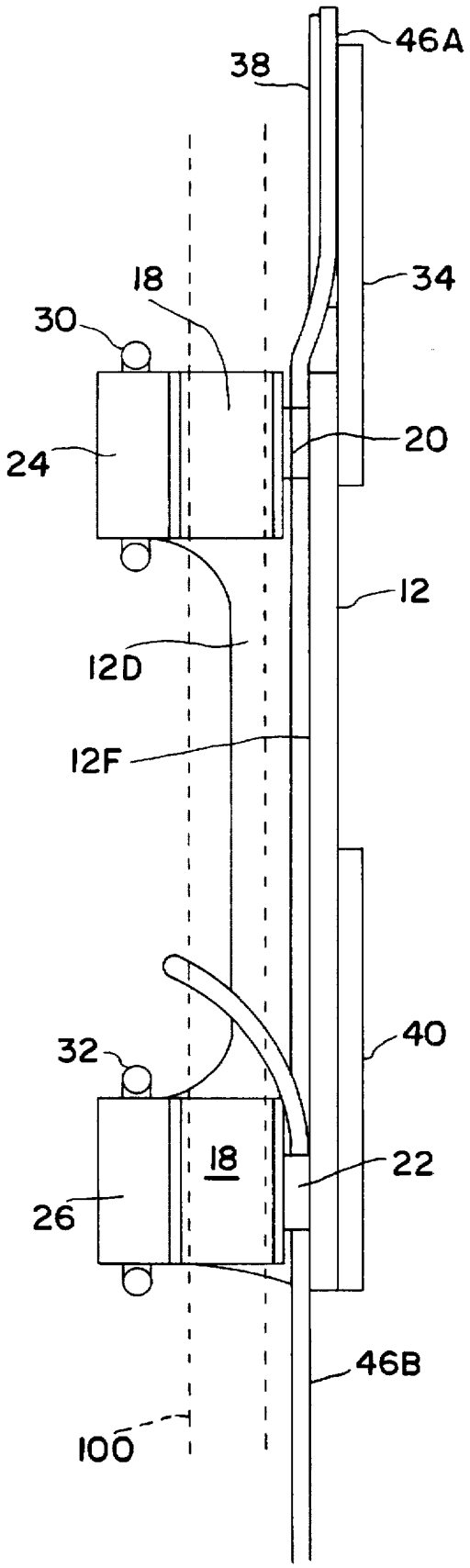
FIG. 6 is a cross-sectional view of the carrier 10 with the snowboard 100 showing the non-slip pads 18 adjacent the snowboard 100.

FIGS. 1 to 7 show the snowboard carrier 10 of the present invention. The carrier 10 is used to transport any elongate object. The snowboard can be constructed to carry various types of recreational boards such as snowboards, skateboards, skis and the like. In the preferred embodiment, the carrier 10 is used to carry a snowboard 100. The snowboard 100 has a top 100A and a bottom 100B with sides 100C and a front surface 100D and a back surface 100E extending therebetween. The snowboard 100 preferably has a length of between about 48.00 and 60.00 inches (121.92 and 152.4 cm) and a width of between about 8.00 and 14.00 inches (20.32 and 35.56 cm). The snowboard 100 preferably weighs about 7 lbs. The carrier 10 includes a panel 12, a first and second carrying strap 34 and 40, a pair of securing straps 24 and 26, non-slip pads 18 and a locking cable 46 (FIG. 5). The panel 12 of the carrier 10 preferably has an essentially rectangular shape with a top 12A, a bottom 12B, a left side 12D and a right side 12C, when viewed from the front, with an outer surface 12E and an inner surface 12F extending therebetween (FIGS. 4 and 5). The sides 12C and 12D of the panel 12 are preferably provided with semicircular cutouts which form spaced apart top and bottom segments 14 and 16. Preferably, the cutouts are evenly spaced between the top 12A and bottom 12B of the panel 12 such that the top and bottom segments 14 and 16 have the same length and width. The panel 12 is preferably constructed of nylon however, any lightweight, durable material could be used. An edging trim (not shown) is provided around the perimeter of the panel 12 to prevent the edges of the panel 12 from fraying and also to increase the aesthetic appearance of the carrier 10.

Non-slip pads 18 are preferably mounted on the inner surface 12F of the panel 12 (FIG. 5). In the preferred embodiment, there are four (4) pads 18. Alternatively, the pads 18 can be a single, continuous non-slip strip (not shown). Each pad 18 is preferably mounted adjacent each of the top and bottom segments 14 and 16 at each of the sides 12C and 12D of the panel 12. The pads 18 are preferably about 2.00×1.00 inches (5.08×2.54 cm) and are mounted to the panel 12 by sewing, however, any type of fastening such as an adhesive (not shown) may be used. The pads 18 are preferably constructed of rubber however, any non-slip material could be used. Preferably the pads 18 are constructed of a material which will not scrape or in any way damage the snowboard 100.

A first loop 20 is preferably provided on the inner surface 12F of the panel 12 adjacent the top 12A and the right side 12C of the panel 12 (FIG. 5). The loop 20 is preferably mounted parallel to the top 12A of the panel 12. In the preferred embodiment, the first loop 20 is mounted on the inner surface 12F of the panel 12 at the point where the first end 34A of the first carrying strap 34 is mounted on the outer surface 12E of the panel 12. The first loop 20 preferably extends across the width of the first end 34A of the first carrying strap 34 (to be described in detail hereinafter). A second loop 22 is preferably provided on the inner surface 12F of the panel 12 at the point where the first end 40A of the second carrying strap 40 (to be described in detail hereinafter) is mounted on the outer surface 12E of the panel 12. The second loop 22 preferably extends across the width of the second carrying strap 40 such that the second loop 22 is at an angle with respect to the top 12A of the panel 12. The loops 20 and 22 are preferably about 1.00 inches (2.54 cm) wide with a length of 2.0 inches (5.08 cm). The loops 20 and 22 allow for slidably positioning the locking cable 46 (to be described in detail hereinafter) adjacent the inner surface 12F of the panel 12.

A top and a bottom securing strap 24 and 26 are preferably mounted on the top and bottom segments 14 and 16 respectively, of the right side 12C of the panel 12. Alternatively, the securing straps 24 and 26 are mounted on the left side 12D of the panel 12 and the securing buckles 30 and 32 (to be described in detail hereinafter) are mounted on the right side 12C of the panel 12. In the preferred embodiments, the straps 24 and 26 are identical and therefore only the top strap 24 will be described in detail. The top strap 24 has a first and second end 24A and 24B with an inner surface 24C and an outer surface 24D therebetween. The top strap 24 is preferably mounted at the first end 24A to the top segment 14 such that the inner surface 24C of the top securing strap 24 is adjacent the outer surface 12E of the panel 12. The top strap 24 is preferably the same width as the top segment 14. The outer surface 24D of the strap 24 is provided with a fastener 28 (FIG. 4). One half of the fastener 28 is adjacent the first end 24A of the strap 24 and the other, opposite half of the fastener 28 is adjacent the second end 24B of the strap 24. Preferably, the fastener 28 is adjustable to allow for transporting snowboards 100 having different widths. The fastener 28 is preferably a hook and loop fastener 28 such as Velcro®.

A top and a bottom securing buckle 30 and 32 are mounted on the top and bottom segments 14 and 16 respectively, on the left side 12D of the panel 12. Preferably, the top and bottom securing buckles 30 and 32 are identical and therefore, only the top buckle 30 will be described. In the preferred embodiment, the top buckle 30 is rectangular in shape and is mounted such that the top segment 14 extends around one of the longer sides of the buckle 30 to secure the top buckle 30 on the top segment 14. The length of the long side of the top buckle 30 is preferably slightly greater than the width of the top securing strap 24 to allow for easy insertion of the strap 24 into the buckle 30. The buckles 30 and 32 are preferably constructed of plastic, although, any lightweight, durable material can be used.

The first carrying strap 34 has first and second ends 34A and 34B with an inner and outer surface 34C and 34D spaced therebetween. The first carrying strap 34 is mounted at the first end 34A on the top 12A of the panel 12 adjacent the right side 12C of the panel 12. The strap 34 is mounted such that the inner surface 34C of the carrying strap 34 is adjacent the outer surface 34C of the panel 12 and the second end 34B of the strap 34 extends upward away from the top 12A of the panel 12 (FIG. 4). The first carrying strap 34 is preferably mounted essentially perpendicular to the top 12A of the panel 12 (FIG. 5). The second end 34B of the first carrying strap 34 is provided with one half of the carrying strap fastener 36. The inner surface 34C of the first carrying strap 34 has a flap 38 which extends almost the entire length of the strap 34 and provides a covered passageway on the inner surface 34C of the strap 34 for the locking cable 46 (FIG. 5). The fastener 36 is preferably a buckle-like device which allows for quick and easy attachment of the second ends 34B and 40B of the first and second carrying straps 34 and 40.

The second carrying strap 40 also has first and second ends 40A and 40B with an inner and outer surface 40C and 40D spaced therebetween. The second carrying strap 40 is mounted at the first end 40A to the bottom 12B of the panel 12 adjacent the left side 12D of the panel 12. In the preferred embodiment, the bottom 12B of the panel 12 adjacent the left side 12D is provided with an extension 42 which extends downward beyond the bottom 12B of the panel 12 (FIG. 5). The extension 42 allows for a more secure mounting of the first end 40A of the second carrying strap 40 onto the panel 12 which allows the second carrying strap 40 to be mounted at an angle which allows for more stable carrying of the snowboard 100. The second carrying strap 40 is preferably mounted such that the inner surface 40C of the strap 40 is adjacent the outer surface 12E of the panel 12 and the second end 40B of the strap 40 extends upward and outward at an angle away from the left side 12D toward the top 12A of the panel 12 (FIG. 4). The second carrying strap 40 is mounted such that an acute angle $\alpha$ is formed between the center line A—A of the first carrying strap 34 and the center line B—B of the second carrying strap 40 (FIG. 4). In the preferred embodiment, the angle $\alpha$ is between about 25° to 80°. The other half of the carrying strap fastener 36 is mounted on the second end 40B of the second carrying strap 40. The mounting of the fastener 36 on the second end 40B of the second carrying strap 40 is preferably adjustable which allows the length of the second carrying strap 40 to be varied. The other half of the fastener 36 is a loop with a center bar over and around which is mounted the second end 40B of the second carrying strap 40. The fastener 36 is similar to adjustable loop belts well known in the art. The inner surface 40C of the second carrying strap 40 has a securing loop 44 adjacent the first end 40A of the strap 40 for slidably holding the second end 46B of the locking cable 46 (FIG. 5). The carrying straps 34 and 40 are preferably constructed of nylon and have a width of 2.00 inches (5.08 cm).

The locking cable 46 has first and second ends 46A and 46B and extends from the first carrying strap 34 across the inner surface 12F of the panel 12 through the first and second loops 20 and 22 to the second carrying strap 40. The first end 46A of the cable 46 is preferably adjacent the second end 34B of the first carrying strap 34. The second end 46B of the cable 46 is preferably adjacent the first end 40A of the second carrying strap 40. The cable 46 extends from the second end 34B of the first carrying strap 34 and through the passageway formed by the flap 38 on the inner surface 34C of the first carrying strap 34 through the first loop 20 on the inner surface 12F of the panel 12 across the inner surface 12F of the panel 12 and through the second loop 22 and finally, through the securing loop 44 on the inner surface 40C of the second carrying strap 40 adjacent the first end 40A (FIG. 5). The cable 46 is preferably constructed of metal cables which are wrapped or braided together. However, any material which is lightweight and difficult to cut or break can be used.

Figure 9:
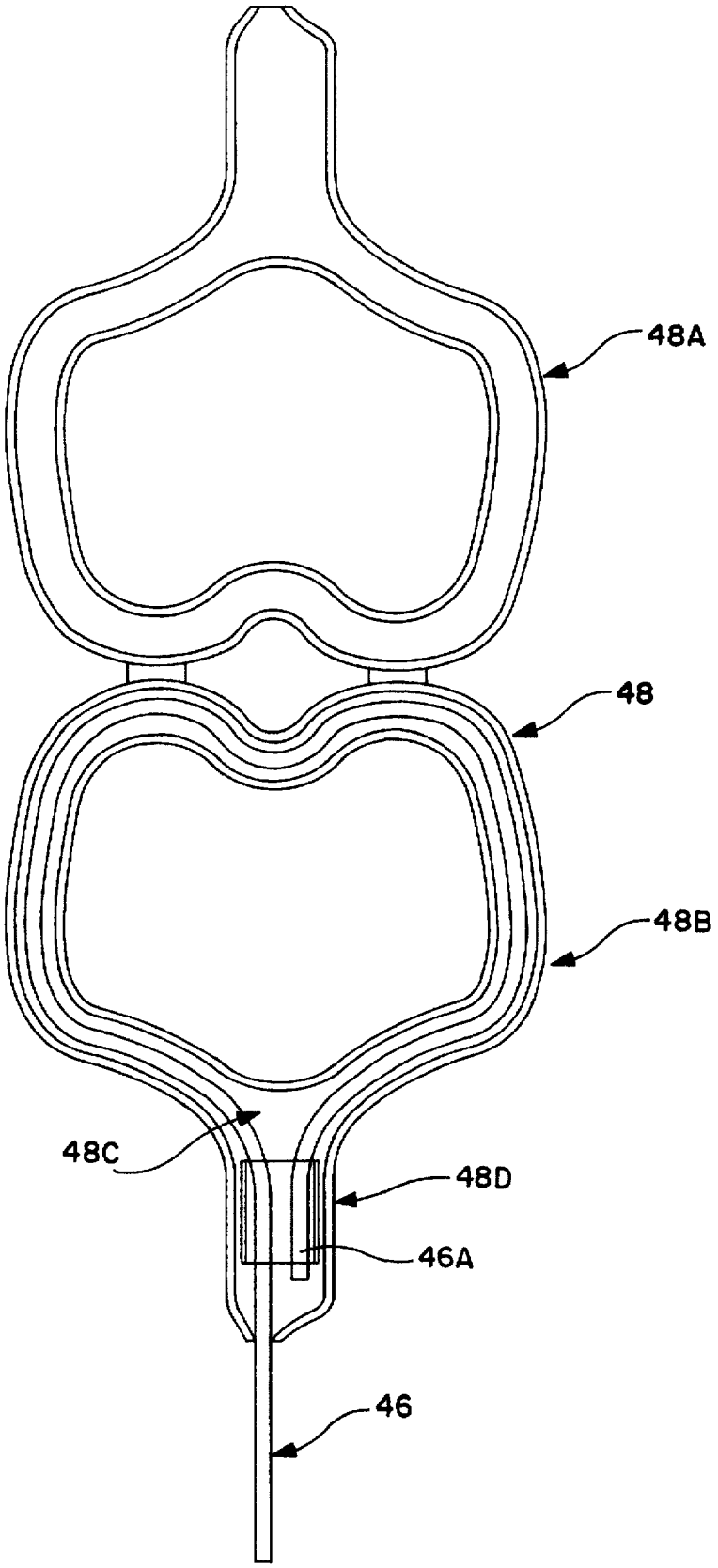
FIG. 9 is a front view of the handle 48 of the locking cable 46 with the upper and lower half 48A and 48B apart and showing the cable 46 within the channel 48C of the handle 48.

The first and second ends 46A and 46B of the cable 46 are preferably provided with first and second handles 48 and 50 (FIG. 5). The handles 48 and 50 are preferably similar and therefore, only the first handle 48 will be described in detail. In the preferred embodiment, the handle 48 is essentially heart-shaped with an opening of a shape which allows the user 102 to insert two (2) fingers into the opening of the handle 48 to pull the cable 46. The handle 48 is preferably constructed as an upper and lower half 48A and 48B which are hinged together. The lower half 48B of the handle 48 is provided with a channel 48C which extends completely around the perimeter of the handle 48 and is approximately the same width as the diameter of the cable 46 (FIG. 9). The base 48D of the handle 48 is preferably of a width such as to accommodate two (2) diameters of the cable 46. To fasten the first handle 48 onto the first end 46A of the cable 46, the end 46A of the cable 46 is inserted into the channel 48C and wrapped completely around the perimeter of the handle 48 such that the first end 46A of the cable 46 is looped back to the base 48D of the handle 48 adjacent the remainder of the cable 46. The first end 46A of the cable 46 is then crimped to the remainder of the cable 46 to secure the handle 48 on the end 46A of the cable 46. The top half 48A of the handle 48 is then snap fit over the bottom half 48B of the handle 48. Preferably, once the top half 48A has been snapped onto the bottom half 48B, the halves 48A and 48B of the handle 48 cannot be separated. The handles 48 are preferably constructed of high density plastic or metal material. The cable 46 is provided with a pull tab 52 slidably mounted around the cable 46 between the first and second loops 20 and 22. The pull tab 52 allows the ends 46A and 46B of the cable 46 to be positioned adjacent the inner surfaces 34C and 40C of the first and second carrying straps 40 such that the cable 46 does not interfere with use of the carrier 10 during transport of the snowboard 100. The panel 12 can also be provided with a handle (not shown) mounted on the outer surface 12E of the panel 12 adjacent the right side of the panel 12. The handle preferably extends parallel to the sides 12C and 12D of the panel 12 and allows the carrier 12 with the snowboard 100 to be carried by the user 102 by the hand similarly to a briefcase.

IN USE

The carrier 10 is used to transport a snowboard 100 on the back 110 of the user 102. To use the carrier 10 to transport a snowboard 100, the snowboard 100 is first mounted in the carrier 10. The snowboard 100 is mounted such that the snowboard 100 is adjacent the inner surface 12F of the panel 12 with the sides 100C of the snowboard 100 adjacent the sides 12C and 12D of the panel 12. The carrier 10 is positioned between the bindings 112 of the snowboard such that the back surface 100E of the snowboard 100 is adjacent the inner surface 12F of the panel 12. The securing straps 24 and 26 are then extended across the front surface 100D of the board 100 through the securing buckles 30 and 32 at the other side 12C or 12D of the panel 12. The second end 24B of the first securing strap 24 is folded back onto the remainder of the strap 24 and fastened onto the inner surface 24C of the strap 24 using the fastener 28. The second securing strap 26 is fastened similarly. The straps 24 and 26 are pulled tight before fastening such that the board 100 is adjacent the inner surface 12F of the panel 12. The panel 12 is preferably of such a length between sides 12C and 12D that when the securing straps 24 and 26 are fully fastened the sides 12C and 12D of the panel 12 extend around the sides 10C of the snowboard 100 such that the panel 12 is adjacent the front surface 100D and back surface 100E of the snowboard 100 with the non-slip pads 18 adjacent and in contact with the side 100C of the snowboard 100. The carrier 10 is preferably positioned on any of the recreational boards to be transported such that the non-slip pads 18 make contact with the sides of the boards. The pads 18 are of such a size as to completely span the thickness of the sides 100C of the snowboard 100. Alternatively, the pads 18 are larger than the thickness of the snowboard 100 such that when the securing straps 24 and 26 are securely fastened, the pads 18 extend beyond the sides 100C of the snowboard 100 and come in contact with the front and back surfaces 100D and 100E of the snowboard 100 which acts to more securely hold the snowboard 100 in position. In the preferred embodiment, the snowboard 100 is positioned in the carrier 10 such that approximately 33% of the snowboard 100 is above the carrier 10. The second ends 34B and 40B of the first and second carrying straps 34 and 40 are fastened together using the fastener 36 to form a complete strap.

The carrier 10 can be mounted on the user 102 in two ways. In the preferred embodiment, the user 102 inserts an arm 104 and head 106 through the connected carrying straps 34 and 40 such that the complete carrying strap extends diagonally across the torso 108 of the user 102 (FIG. 1) with the panel 12 of the carrier 10 adjacent the back 110 of the user 102. The complete strap is mounted around the user 102 such that the outer surface 34D of the first carrying strap 34 is adjacent the shoulder 103 of the user 102 and the outer surface 40D of the second carrying strap 40 extends around the torso 108 of the user 102 beneath the arm 104 of the user 102 (FIG. 1). When the carrier 10 is correctly mounted, the snowboard 100 is positioned vertically along the back 110 of the user 102 such that the top 100A of the snowboard 100 extends upward or above the user's head 106 depending on the height of the user 102 and the length of the board 100. The first and second carrying straps 34 and 40 lie flat and do not buckle which allows the second carrying strap to be adjustable. The flat portion of the straps 34 and 40 also increases the comfort of the user 102 when wearing the carrier 10. The user 102 preferably adjusts the length of the second carrying strap 40 to mount the carrier 10 with the snowboard 100 securely on the user 102 to prevent extraneous movement of the carrier 10 with the snowboard 100 during use. The adjustment of the second strap 40 can also be used to position the carrier 10 vertically along the back 110 such that the weight of the board 100 is evenly centered to allow for easy carrying of the board 100. In an alternate carrying position (not shown), the user 102 inserts an arm 104 through the complete carrying strap 34 and 40 to carry the carrier 10 and board 100 on one shoulder. In this position, the bottom 100B of the board 100 is able to move under the arm 104 adjacent one side of the user 102. The user 102 can adjust the length of the second carrying strap 40 to position the snowboard 100 for easier carrying.

Figure 7:
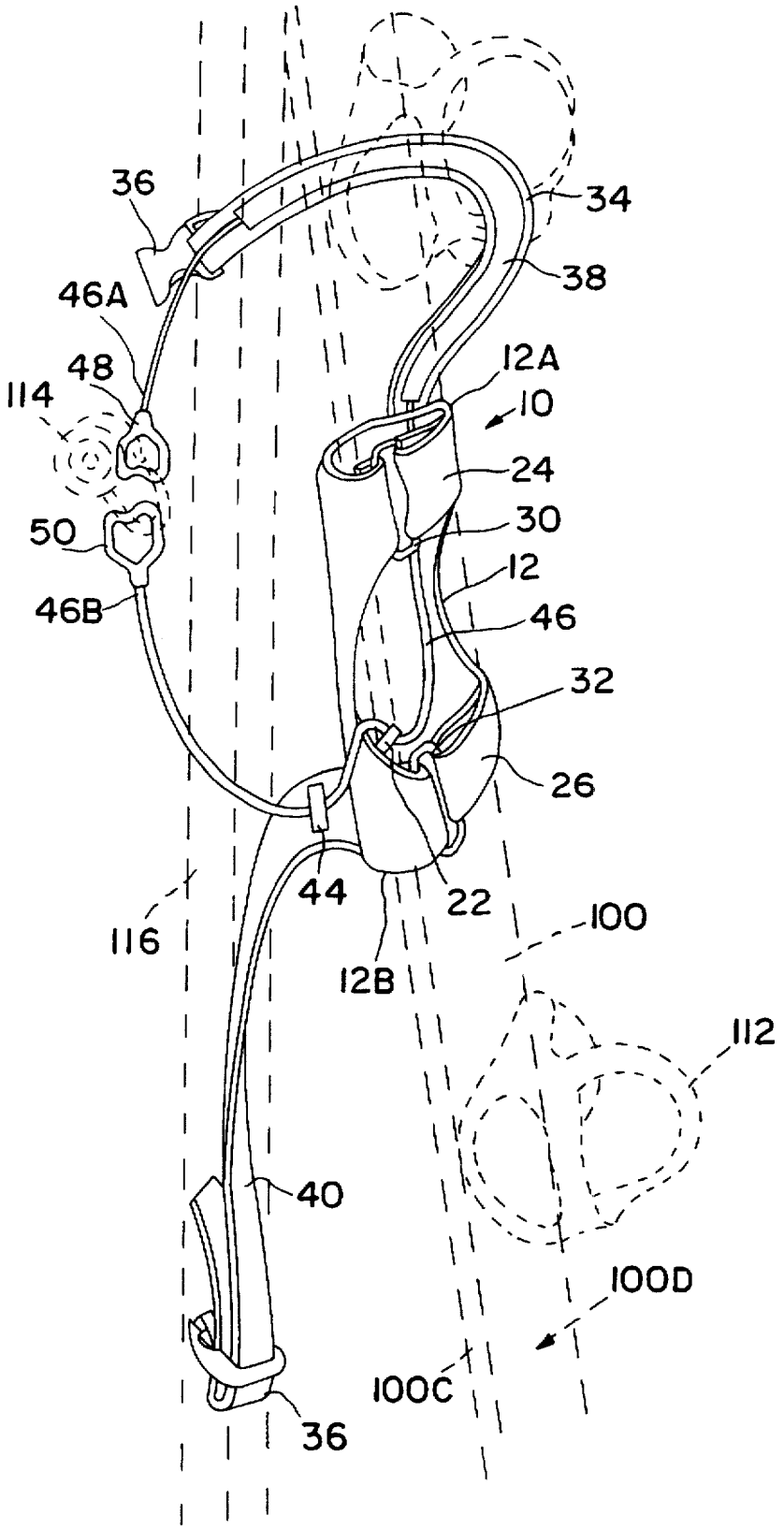
FIG. 7 is a perspective view of the carrier 10 and the snowboard 100 with the locking cable 46 extending around a fixed object 116 and the handles 48 of the cable 46 locked together with a lock 114.
Figure 8:
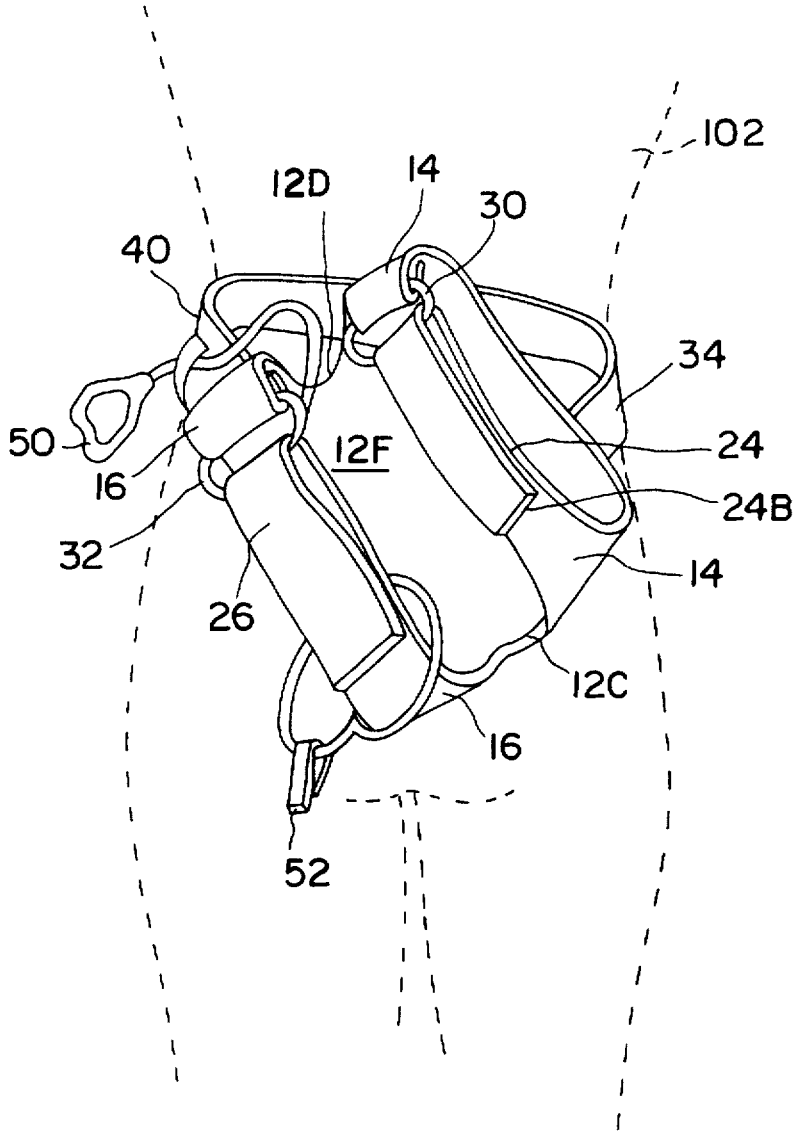
FIG. 8 is a front view of the user 102 with the carrier 10 in the waist pack configuration mounted around the waist of the user 102.

The carrier 10 can also be used as an antitheft locking device, when the user 102 wishes to leave the snowboard 100 unattended in the carrier 10. To secure the snowboard 100 and the carrier 10, the user 102 pulls the handles 48 of the locking cable 46 which pulls the cable 46 taut and extends the ends 46A and 46B of the cable 46 beyond the carrying straps 34 and 40 of the carrier 10. One of the ends 46A or 46B of the cable 46 is then extended through one of the bindings 112 of the snowboard 100. When carrying another elongate object, the locking cable 46 is extended through any opening on the object or through an attachment on the object. In the preferred embodiment, the first carrying strap 34 with the first end 46A of the cable 46 is extended through the binding 112 (FIG. 7). The handles 48 of the cable 46 are then extended around a fixed object 116 and locked together using a lock 114. Finally, when the cable 46 is unlocked and not in use, the pull tab 52 is pulled by the user 102 to retract the handles 48 of the cable 46 back to adjacent the inner surface 34C and 40C of the first and second carrying straps 34 and 40 such that the handles 48 of the cable 46 are not dangling such that they do not interfere with the use of the carrier 10.

When not being used to carry a snowboard 100, the carrier 10 can be used as a waist pack to carry other objects (not shown). The user 102 fastens the first and second carrying straps 34 and 40 around the waist such that the panel 12 is adjacent the waist of the user 102. The second end 40B of the second carrying strap 40 is pulled through the buckle of the fastener 36 to tighten the carrying strap around the waist of the user 102. The carrier 10 can be positioned with the panel 12 adjacent the front or rear of the user 102. The object to be carried is mounted adjacent the panel 12 with the securing straps 24 and 26 mounted across the object and pulled tightly through the securing buckles 30 and 32 and fastened to hold the object securely in the carrier 10.

It is intended that the foregoing description be only illustrative of the present invention and that the present invention be limited only by the hereinafter appended claims.

I claim:

1. An apparatus for carrying an elongate object on a back of a user, which comprises:

(a) a panel having a top and a bottom and opposed sides with an inner surface and an outer surface spaced therebetween;

(b) a securing strap having opposed ends and extending from one side of the panel;

(c) an attachment means provided on the other side of the panel opposite the securing strap for holding the securing strap in position across the inner surface of the panel; and (d) a complete carrying strap having a first end and a second end with the first end provided on the panel adjacent the top and one of the sides of the panel with the second end provided on the panel adjacent the bottom and the other side of the panel, wherein the second end of the complete carrying strap provided on the panel such that the complete carrying strap extends upward from the second end of the carrying strap at an angle toward the top of the panel such that an acute angle is formed between the first end and second end of the carrying strap, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user.

2. The apparatus of claim 1 wherein the angle between the first and second ends of the strap is between about 25° to 80°.

3. The apparatus of claim 1 wherein the length of the carrying strap is adjustable to vertically position the apparatus along the back of the user.

4. The apparatus of claim 1 wherein there are two securing straps one adjacent the top of the panel and one adjacent the bottom of the panel.

5. The apparatus of claim 1 wherein non-slip pads are mounted on the inner surface of the panel and are in contact with the elongate object and prevent the elongate object from moving vertically when the elongate object is mounted in the apparatus and the apparatus is mounted on the user.

6. The apparatus of claim 1 wherein the length of the securing strap is adjustable to allow a variety of sized elongate objects to be carried.

7. The apparatus of claim 1 wherein the complete carrying strap includes a first carrying strap and a second carrying strap.

8. The apparatus of claim 7 wherein the first carrying strap has first and second ends and wherein the first end of the first carrying strap is the first end of the complete carrying strap.

9. The apparatus of claim 8 wherein the second carrying strap has first and second ends and wherein the first end of the second carrying strap is the second end of the complete carrying strap.

10. The apparatus of claim 9 wherein the second ends of the first and second straps have a fastener and wherein the second ends of the first and second strap are fastened together using the fastener to provide the complete carrying strap.

11. An apparatus for carrying an elongate object on a back of a user, which comprises:

(a) a panel having a top and a bottom and opposed sides with an inner surface and an outer surface spaced therebetween;

(b) a securing strap having opposed ends and extending on one side of the panel;

(c) an attachment means provided on the other side of the panel opposite the securing strap for holding the securing strap in position across the inner surface of the panel;

(d) a complete carrying strap having a first end and a second end with the first end provided on the panel adjacent the top and one of the sides of the panel with the second end provided on the panel adjacent the bottom and the other side of the panel, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user; and (e) a locking cable having opposed ends and extending from the first end of the carrying strap to the second end of the carrying strap across the inner surface of the panel for locking the apparatus with the elongate object to a fixed object to prevent theft of the elongate object.

12. The apparatus of claim 11 wherein the length of the carrying strap is adjustable to vertically position the apparatus along the back of the user.

13. The apparatus of claim 11 wherein the length of the securing strap is adjustable to allow a variety of sized elongate objects to be carried.

14. The apparatus of claim 11 wherein non-slip pads are mounted on the inner surface of the panel and are in contact with the elongate object and prevent the elongate object from moving vertically when the elongate object is mounted in the apparatus and the apparatus is mounted on the user.

15. The apparatus of claim 11 wherein each of the ends of the locking cable is provided with a handle.

16. The apparatus of claim 15 wherein each of the handles has an opening which is of such a size as to accommodate two fingers of the user.

17. The apparatus of claim 16 wherein each of the ends of the locking cable extends around a perimeter of the opening of each of the handles within the handle.

18. The apparatus of claim 11 wherein the second end of the complete carrying strap is mounted such that the complete carrying strap extends upward from the second end of the carrying strap at an angle toward the top of the panel such that an acute angle is formed between the first end and second end of the carrying strap.

19. The apparatus of claim 18 wherein the angle is between about 25° to 80°.

20. An apparatus for carrying an elongate object on a back of a user, which comprises:

(a) a panel having a top and a bottom with opposed sides and an outer surface and an inner surface spaced between the sides;

(b) a securing means including a securing strap having opposed ends and extending from one side of the panel and a loop provided on the other side of the panel wherein the securing strap extends through the loop such that the strap extends across the elongate object to hold the elongate object in the apparatus when the elongate object is mounted adjacent the inner surface of the panel;

(c) a first carrying strap having opposed ends and provided at one end on the panel adjacent the top and one side of the panel such as to extend outward away from the panel; and (d) a second carrying strap having opposed ends and provided at one end on the panel adjacent the bottom and the other side of the panel so as to extend upward at an angle toward the top of the panel such that an acute angle is formed between the first carrying strap and the second carrying strap, wherein the second ends of the first and second carrying straps are fastened together to form a complete carrying strap and wherein the complete carrying strap can be mounted over one shoulder and around a neck of the user such that the complete carrying strap extends diagonally across a torso of the user with the outer surface of the panel adjacent the back of the user and wherein the elongate object can be mounted adjacent the panel and held in a vertical position along the back of the user.

21. The apparatus of claim 20 wherein non-slip pads are mounted on the inner surface of the panel adjacent the top and bottom and each of the sides of the panel.

22. The apparatus of claim 20 wherein the apparatus has a releasable fastener with one half of the fastener provided on the second end of the first carrying strap and the other half of the fastener provided on the second end of the second carrying strap to allow for releasably fastening the second ends of the first and second carrying straps together.

23. The apparatus of claim 20 wherein the length of the second carrying strap is adjustable to vertically vary a position of the apparatus on the back of the user.

24. The apparatus of claim 20 wherein the securing means is adjustable to allow for carrying elongate objects having different widths.

25. A combination elongate object carrier and waist pack, which comprises:

(a) a panel having a top and a bottom and opposed sides with an inner surface and an outer surface spaced therebetween;

(b) a securing strap having opposed ends and extending from one side of the panel;

(c) an attachment means provided on the other side of the panel opposite the securing strap; and (d) a complete carrying strap having a first end and a second end with the first end provided on the panel adjacent the top and one of the sides of the panel and the second end provided on the panel adjacent the bottom and the other side of the panel, wherein the second end of the complete carrying strap extends upward from the second end of the carrying strap at an angle toward the top of the panel such that an acute angle is formed between the first end and second end of the carrying strap, wherein in the elongate object carrier configuration the carrying strap can be mounted over one shoulder and around a neck of the user such that the complete carrying strap extends diagonally across a torso of the user with the outer surface of the panel adjacent the back of the user, wherein the object can be mounted adjacent the panel and held in a vertical position along the back of the user, and wherein in the waist pack configuration, the first and second carrying straps are extended around a waist of the user and fastened together at their second ends such that the outer surface of the panel is adjacent the waist of the user.

26. A method for carrying an elongate object adjacent the back of a user, the elongate object having a top and a bottom with sides therebetween, which comprises:

(a) providing a panel having a top and a bottom and opposed sides with an inner surface and an outer surface spaced therebetween; a securing strap having opposed ends and extending from one side of the panel; an attachment means provided on the other side of the panel opposite the securing strap for holding the securing strap in position across the inner surface of the panel; and a complete carrying strap having a first end and a second end with the first end provided on the panel adjacent the top and one of the sides of the panel and the second end provided on the panel adjacent the bottom and the other side of the panel, wherein the second end of the complete carrying strap extends upward from the second end of the carrying strap at an angle toward the top of the panel such that an acute angle is formed between the first end and second end of the carrying strap, wherein the carrying strap can be mounted over one shoulder and around a neck of the user such that the complete carrying strap extends diagonally across a torso of the user with the outer surface of the panel adjacent the back of the user and wherein the object can be mounted adjacent the panel and held in a vertical position along the back of the user;

(b) mounting the elongate object adjacent the inner surface of the panel such that the elongate object is spaced between the sides of the panel with the sides of the elongate object adjacent the sides of the panel;

(c) securing the securing strap across the elongate object such that the elongate object is completely encircled by the panel and the securing strap to prevent extraneous movement of the elongate object; and (d) extending a head and a shoulder through the complete carrying strap such that the complete carrying strap extends diagonally across a torso of the user and the outer surface of the panel is adjacent the back of the user wherein the elongate object is held adjacent the back of the user in a vertical position such that the top of the elongate object is adjacent a head of the user.

27. The method of claim 26 wherein a locking cable having opposed ends is mounted on the inner surface of the panel and extends from the one end of the carrying strap across the inner surface of the panel to the second end of the carrying strap, wherein the elongate object is a recreational board having a binding and wherein after carrying the elongate object the user removes the carrier and pulls the ends of the locking cable to tighten the cable, extends the ends of the cable through the binding of the board and around a fixed object and lockably secures the ends of the cable together to prevent theft of the elongate object.

* * * * *